US005992813A

United States Patent [19]

Keers

[11] Patent Number: 5,992,813

[45] Date of Patent: Nov. 30, 1999

[54] PICTURE HANGING SYSTEM

[76] Inventor: Robertus Adrianus Maria Keers, Heermraadsingel 9, NL-3641 JH Mijdrecht, Netherlands

[21] Appl. No.: 09/005,589

[22] Filed: Jan. 12, 1998

[30] Foreign Application Priority Data

Jan. 10, 1997 [GB] United Kingdom ..... 9700475

[51] Int. Cl.[6] ..... A47F 5/08

[52] U.S. Cl. ..... 248/489; 248/223.41; 248/298.1; 248/495

[58] Field of Search ..... 248/225.11, 298.1, 248/215, 307, 317, 323, 320, 322, 316.3, 339, 340, 341, 342, 489, 494, 495; 211/162; 160/392; 40/757

[56] References Cited

U.S. PATENT DOCUMENTS

| | | | |
|---|---|---|---|
| 393,062 | 11/1888 | Fay | 248/215 X |
| 394,144 | 12/1888 | Sword | 248/307 X |
| 961,614 | 6/1910 | Johnsons | 248/494 X |
| 1,220,021 | 3/1917 | Smyrk | 248/495 X |
| 1,930,965 | 10/1933 | Christy | 248/307 |
| 3,805,873 | 4/1974 | Bloomfield | 160/392 |
| 4,391,375 | 7/1983 | Joyce . | |
| 4,973,021 | 11/1990 | Schuite | 248/215 X |
| 5,009,540 | 4/1991 | Nolan | 160/392 X |
| 5,409,191 | 4/1995 | Wenmaekers | 248/317 |
| 5,685,516 | 11/1997 | Simmons | 248/489 |

FOREIGN PATENT DOCUMENTS

| | | |
|---|---|---|
| 7-11972 | 2/1995 | Japan . |
| 228984 | 2/1925 | United Kingdom . |
| 381156 | 9/1932 | United Kingdom . |
| 2 183 388 | 6/1987 | United Kingdom . |
| 2 206 616 | 1/1989 | United Kingdom . |
| 2 240 269 | 7/1991 | United Kingdom . |

*Primary Examiner*—Derek J. Berger
*Attorney, Agent, or Firm*—Young & Thompson

[57] ABSTRACT

A picture hanging system comprises an elongate support member arranged for attachment to a wall or ceiling so as to define a cavity, an opening for the cavity having a projection arranged to restrict the width of the opening; and a picture mounting unit comprising a rigid element for attachment to a support element for the picture, wherein the rigid element is configured so as to be insertable through the opening in a first orientation thereof, in which second orientation the rigid element cannot pass through the opening.

3 Claims, 2 Drawing Sheets

PICTURE HANGING SYSTEM

FIELD OF THE INVENTION

The present invention relates to a system for hanging pictures or the like on a wall, and more particularly to such a system which is as unobtrusive as possible, which is quick and simple to use, which requires no additional apparatus and which allows pictures to be added or removed from the system without difficulty.

BACKGROUND OF THE INVENTION

Pictures are hung in various environments for different reasons. For example, at home, a picture may be hung for decorative reasons whereas in a gallery a picture may be hung to display the picture to a wide audience. In offices, pictures are used to decorate the office interior and can also be employed as a status symbol for that company. In all such cases, the means for hanging the picture should not detract from the picture and is preferably thus as unobtrusive as possible.

Track systems are known for displaying pictures, for example as shown in FIGS. 1 to 4. Such systems generally include an elongate track that is fastened to a wall, a lower portion of the track being configured to receive a hook or, at an open end, the enlarged head of a catch that is slidably received in the track.

In such systems a cord can be attached to the hook or catch which in turn is attached to the picture to be hung. Alternatively, the catch itself projects downwardly to a position where a picture can be attached directly thereto. With such arrangements, the catch can be moved along the track so as to provide alternative positions for hanging the picture on the wall.

Such systems suffer however from certain problems. Firstly, with the arrangements shown in FIGS. 1 to 3, the catch member projects below the track and thus detracts from the appearance of the picture being displayed. With the arrangements shown in FIGS. 3 and 4, additional catch members can be introduced into the track only from an open end thereof. Hence, if an additional picture is to be hung between existing pictures then all the pictures between the desired position and the open end of the track have to be taken down from their respective hooks or catches and shifted along one hook or catch. This can involve a large amount of work and discourages the moving around of pictures, for example to evaluate their best position, and reduces the inclination to swap picture or to introduce additional pictures.

It is therefore an object of the present invention to provide a picture hanging system that seeks to alleviate such problems associated with known arrangements.

According to a first aspect of the present invention there is provided a picture hanging system comprising an elongate support member arranged for attachment to a wall or ceiling so as to define a cavity, an opening for the cavity including a projection arranged to restrict the width of the opening; and a picture mounting means comprising a rigid element for attachment to a support means for the picture;

wherein the rigid element is configured so as to be insertable through the opening in a first orientation thereof and to be movable within the cavity into a second orientation thereof, in which second orientation the element cannot pass through the opening.

With such an arrangement, when a picture is hun using the system, all that the observer will see is the elongate support member and the picture support means. The elongate support member can take the form of a rail and be placed high on the wall, and thus generally out of view, and the picture support means can take the form of a cord, e.g. formed of a substantially transparent material such as nylon, so that the appearance of the picture is not spoiled by any support structure.

Furthermore, the system for attaching the picture mounting means within the elongate support member allows support at any position along its length. Hence, extra pictures can be readily added at any position between existing pictures.

The arrangement of the rigid element and the picture support means allows the rigid element to be easily inserted into and removed from the support member. Once correctly inserted the load applied by way of a picture attached to the picture mounting means acts to securely wedge the rigid element in place within the support member. The picture hanging system thus affords a reliable, strong and durable means for hanging pictures.

Preferably, the elongate support member comprises two parts that are configured to snap-fit together. In this manner, a first said part can be readily fixed to an appropriate wall or ceiling surface, using a suitable connection means, without obstruction from the second part. Once in place, the second part can be snap-fitted to the first part to cover the means of connection of the first part to the wall or ceiling. The second part thus acts at least partly as a cover plate which can be removed if the elongate support member is ever to be taken down and/or repositioned.

Conveniently, the projection is provided on the second part. The connection between the first and second parts may conveniently be arranged so that any load applied by the picture mounting means acts to bias the first and second parts together.

The component parts of the elongate support member are preferably formed of aluminum, produced e.g. by extrusion techniques. Suitable alternative materials may include other metals or plastics. Suitable alternative forming techniques may include roll-forming.

In a further embodiment, the elongate support member may be a single profile with openings for facilitating installation of the elongate support member on the wall or ceiling. Such openings may be coverable by, for example, a clip-on cover.

According to a second aspect of the present invention there is provided a picture hanging system comprising an elongate support member for attachment to a wall or ceiling, the support member having at least one ledge portion that defines, in use, an edge of an opening arranged to be on the underside of the support member; and a picture mounting means comprising a cord attached to a rigid element;

wherein the rigid element is configured so as to be insertable through the opening and, upon subsequent downward movement of the cord, to be pivotable in relation to the cord so as to catch on the ledge portion.

BRIEF DESCRIPTION OF THE DRAWINGS

Examples of the present invention will now be described by reference to the accompanying drawings, of which.

DESCRIPTION OF THE PREFERRED EMBODIMENTS

Figure 1:
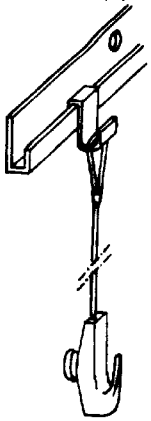
fig-1 PRIOR ART
FIGS. 1 to 4 show known arrangements.
Figure 2:
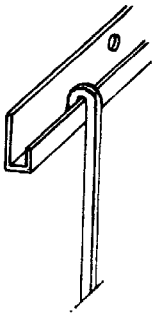
fig-2 PRIOR ART
Figure 3:
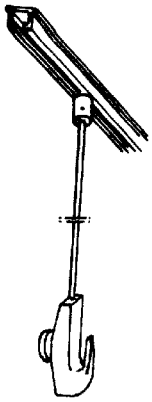
fig-3 PRIOR ART
Figure 4:
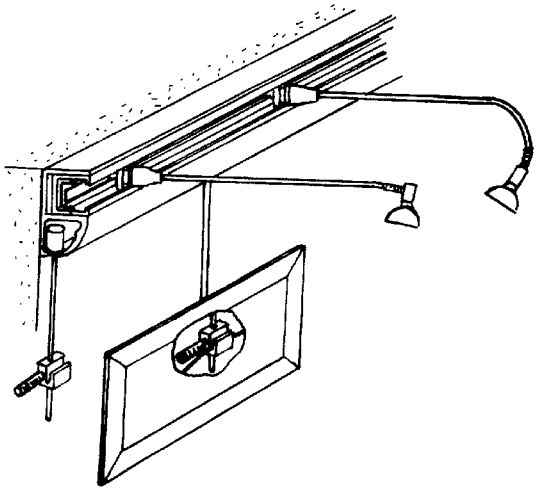
fig-4 PRIOR ART
Figure 5:
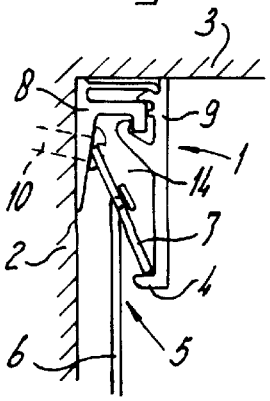
FIGS. 5 and 6 show in cross-section a first embodiment of the present invention.

As shown in FIG. 5, a picture hanging system comprises an elongate support member 1 for attachment to a wall 2 or ceiling 3. The support member takes the form of a rail and has at least one projection or ledge portion 4 that defines an edge of an opening or aperture 5 on the underside of the support member. Once in place on a wall or ceiling, the support member defines a cavity 14. The system further comprises picture mounting means in the form of a cord 6 attached to a rigid element 7. The rigid element may be attached to the cord by any suitable means.

Figure 6:
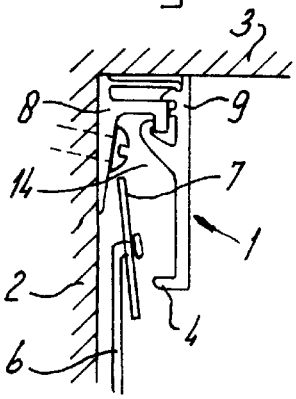

In use of the system, the rigid element is inserted in a first orientation from below through the opening 5, as shown in FIG. 6. Once within the support member 1, the rigid element can pivot about the cord to a new orientation within the cavity 14 so that on a downward movement of the cord, the rigid element catches on the ledge portion 4 as illustrated in FIG. 5 and becomes firmly wedged in place within the support member.

The pivotal nature of the rigid element in relation to the cord allows the rigid element to be easily inserted, and extracted from the support member once the loading of the picture has been removed. Once correctly inserted and loaded, the picture hanging system affords a reliable, strong and durable means for hanging pictures.

The elongate support member 1 comprises two parts 8, 9 that are configured to releasably snap-fit together. In this manner, a first part 8 can be readily fixed to an appropriate wall or ceiling surface, using a suitable connection means, e.g. a screw fitting 10, without obstruction from the second part 9. Alternative connection means may of course be employed for attaching the support member to a wall or ceiling. Once in place, the second part can be fitted onto the first part to cover the means of connection of the first part to the wall or ceiling. The second part thus acts at least partly as a cover plate. As shown, the ledge portion 4 is provided on the second part. The connection between the first and second parts is arranged so that any load applied by the picture mounting means acts to bias the first and second parts together, thus providing a stable arrangement.

The first and second parts of the elongate support member are preferably formed of suitable metals or plastics, in particular aluminum. Extrusion techniques may be used or other suitable techniques, for example roll-forming.

Figure 7:
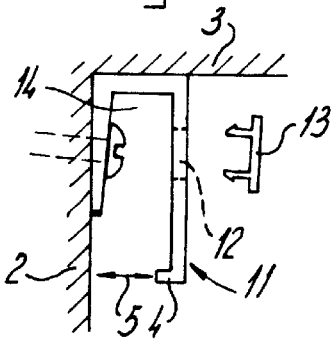
FIG. 7 shows in cross-section a second embodiment of the present invention.

As shown in the further embodiment of FIG. 7, the elongate support member may be a single profile 11 with suitable access openings 12 for installation purposes. Such openings may be covered by for example, a clip-on cover 13.

Figure 8:
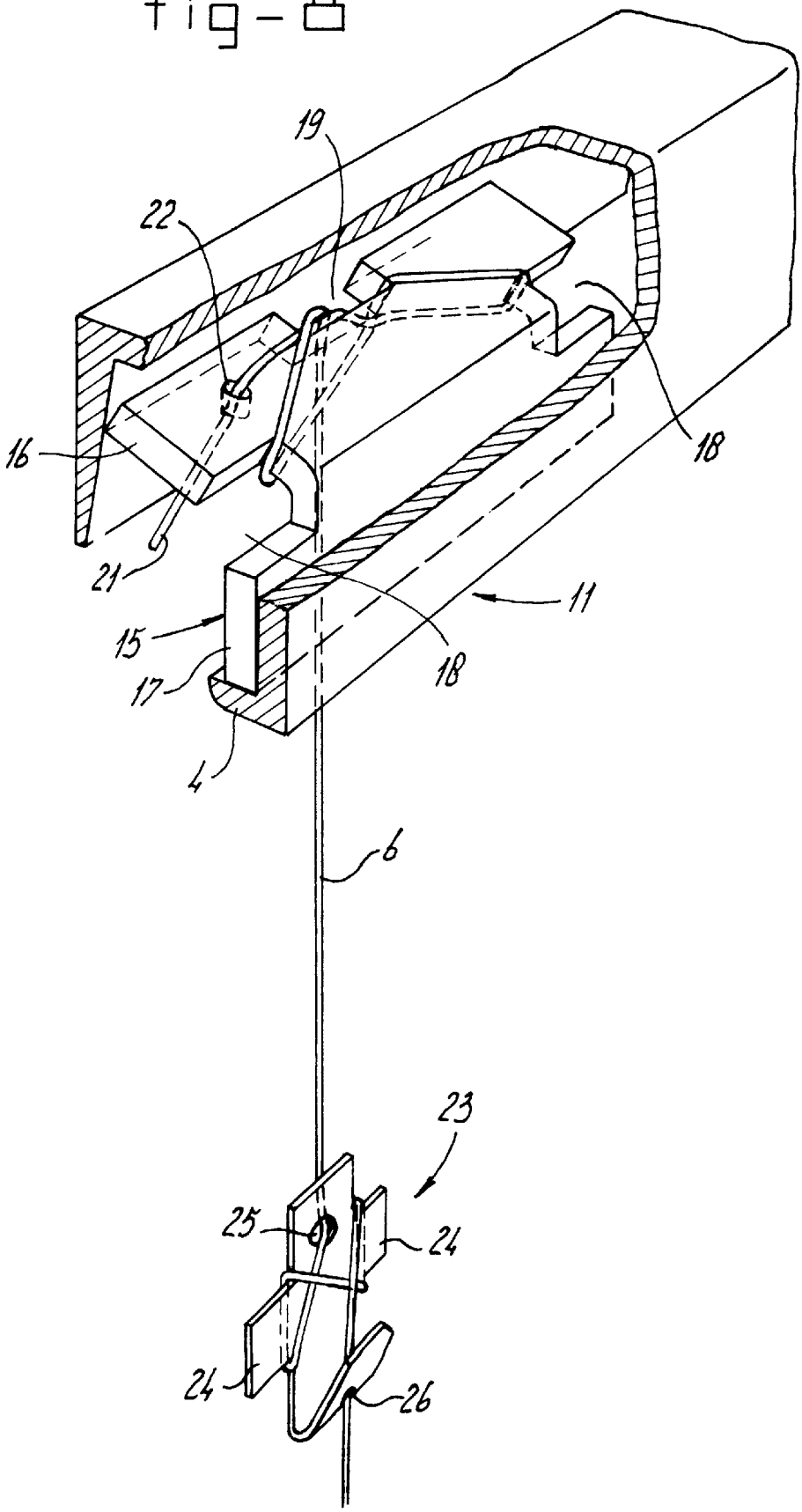
FIG. 8 shows a third embodiment in perspective.

The third embodiment according to FIG. 8 shows the same single profile 11 as in FIG. 7. The rigid element 15 comprises two flanges, 16, 17, which enclose an obtuse angle. Flange 17 rests on projection 4.

The rigid element 15 can be installed in the profile 11 from beneath, by first tilting said element 15.

At its opposite longitudinal ends, the rigid element has two recesses 18. Also flange 16 has a recess 19.

The recesses 18 and 19 accomodate the cord 6 in such a way that it clamps itself. The end 21 of cord 6 is secured in hole 22 of flange 16.

The other end of the cord 6 engages hook 23 in a self-clamping way as well. To that end, hook 23 comprises lateral extensions 24 as well as holes 25, 26, through which the cord 6 has been pulled. The cord 6 engages the lateral extensions 24 in a cross-wise manner, thus providing the self-clamping action.

I claim:

1. A picture hanging system, comprising an elongate support member arranged for attachment to a wall or ceiling so as to define a cavity, an opening for the cavity having a projection arranged to restrict the width of the opening;

a picture mounting means comprising a rigid element for attachment to a support means for the picture;

said rigid element being configured so as to be insertable through the opening in a first orientation thereof, and to be moveable within the cavity into a second orientation thereof, in which second orientation the rigid element cannot pass through the opening;

said elongate support comprising a first part and a second part which are structured and arranged to releasably snap-fit together; and wherein in said second orientation the rigid element rests against both parts, such that any load applied by the picture mounting means acts to urge the first and second parts together.

2. The picture hanging system according to claim 1, wherein the first part is for attachment to the wall or ceiling, and the projection is provided on the second part.

3. The picture hanging system according to claim 1, wherein the picture support means is a flexible cord.

* * * * *